US007048284B1

(12) United States Patent
Seifert

(10) Patent No.: US 7,048,284 B1
(45) Date of Patent: May 23, 2006

(54) ILLUMINATED SKATEBOARD

(75) Inventor: Branden W. Seifert, Burbank, CA (US)

(73) Assignee: Illuminated Sports, Los Angeles, CA (US)

( * ) Notice: Subject to any disclaimer, the term of this patent is extended or adjusted under 35 U.S.C. 154(b) by 0 days.

(21) Appl. No.: 10/890,647

(22) Filed: Jul. 14, 2004

(51) Int. Cl.
*B62M 1/00* (2006.01)

(52) U.S. Cl. ..... 280/79.11; 280/47.34; 280/166; 280/651; 280/47.36

(58) Field of Classification Search ..... 280/220, 280/87.041, 87.021, 459
See application file for complete search history.

(56) References Cited

U.S. PATENT DOCUMENTS 4,997,196 A * 3/1991 Wood ..... 280/87.041
5,119,277 A 6/1992 Copley et al.
6,802,636 B1 10/2004 Bailey, Jr.

* cited by examiner

*Primary Examiner*—Christopher P. Ellis
*Assistant Examiner*—Cynthia F. Collado
(74) *Attorney, Agent, or Firm*—Eric Karich

(57) ABSTRACT

An illuminated skateboard is disclosed including a light string, configured to produce light, mounted about a peripheral edge of a deck. The peripheral edge of the deck extends between a top surface and a bottom surface of the deck. The illuminated skateboard also includes a pair of trucks each having a pair of wheels for supporting the deck, and a driver circuit coupled between an electrical power source and the light string. The driver circuit provides electrical power from the electrical power source to the light string. A method for making the illuminated skateboard is also described.

4 Claims, 3 Drawing Sheets

ILLUMINATED SKATEBOARD

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to skateboards, and more particularly to illuminated skateboards.

2. Description of Related Art

Skateboards, roller blades, and similar products have gained increasing popularity in recent years, primarily for sports and recreational purposes. While the basic structure of a skateboard has remained fairly standard, more recently lighting systems have been added to skateboards and similar products for both safety and for the attention-getting effects. Known skateboard lighting systems include the following:

Copley et al., U.S. Pat. No. 5,119,277, teaches an illuminated skateboard that includes a riding platform with dependent wheels, a front housing and rear housing each secured to the bottom surface of the riding platform. An illumination source in each housing is operable to provide the desired illumination while riding the skateboard.

Ekedal et al., U.S. Pat. No. 5,292,141, teaches a skateboard comprising a rotatable disk mounted on the top surface of the skateboard's riding platform surface for rotatably maneuvering the skateboard in different directions. The skateboard may include front and rear illumination sources mounted within respective front and rear housings secured to the underside of the riding platform.

Standley, U.S. Pat. No. 5,067,058, teaches an improved skateboard having roller trucks attached to the underside of the skateboard deck. The trucks are insulated from the skateboard deck by riser pads of sufficient thickness to receive and house self-contained battery operated lamps. The lamps are positioned to direct light beams from beneath the deck in fore and aft directions. Switch means in the lamps are operable to turn the lamps on and off.

Wood, U.S. Pat. No. 4,997,196, teaches improvements to a skateboard comprising a board having a complete string of LED's embedded in a groove around the periphery of the skateboard in the first embodiment, powered by a microcontroller and a battery mounted to the underside of the board. In the second embodiment, along the same lines, a kit is provided wherein skid bars have the LED's mounted in them, connected by wiring leading to the microcontroller and battery. The kit can be sold for after-market use, and may consist of just the two side boards, or the rear skid board as well, often called the kick board.

Won, U.S. Pat. No. 5,004,256, teaches a combination of a skateboard and electronic device for generating sound and/or light. The electronic device is affixed under the skateboard and a switch means is provided that can be operated by stepping on an operating element thereof.

Maier, U.S. Pat. No. 4,837,494, teaches a generator and rechargeable battery system disclosed for attachment to a ski having an electrically operable load. The invention comprises a rechargeable battery system in which the generator and/or battery can intermittently power a load such as a heating element of a ski boot. The rechargeable battery is detachable and may be recharged by the generator or in the home. Through the use of connecting wires, the generator and rechargeable battery system can be used to supply current to lights affixed to the ski and to power other electrical appliances.

Tuyn et al., U.S. Pat. No. 4,860,585, teaches a measuring and indicating device for a snow skier including a rotatable roller attachable to the rear of a ski and adapted to rotate in rolling contact with the underlying snow utilizing an indicator unit positionable remote of the roller such as upon the wrist of the skier. The device further includes elements supported adjacent the roller for sensing the rotation thereof and generating signals corresponding to the sensed rotation. The indicator unit includes a calculator for receiving the signals generated by the sensing elements and calculating a predetermined characteristic, such as speed or distance, of travel by the snow skier corresponding to the received signals. The indicator unit further includes a display for displaying the calculated characteristic in the form of a numerical value. The device further includes a connecting mechanism interposed between the roller and the ski permitting pivotal movement of the roller between a raised and lowered condition in relation to the rear of the ski and a spring for biasing the roller from the raised condition to the lowered condition so that if the rear end of the ski were to be raised an appreciable distance above the surface of the snow, the roller is maintained in rolling engagement with the underlying snow for measurement calculations. The device is particularly well-suited for accurately measuring a predetermined characteristic of travel even if the ski is tipped upon one side or the other.

Okko et al., U.S. Pat. No. 5,738,432, teaches a method and an adjustable portable illumination device, removably attachable to a user's shoe or garment, enabling hands-free operation, and allowing the user to see and be seen. The device has a light housing, a light assembly having an illumination member encapsulated in the light housing, a power source for providing power to the illumination member, a movable plate, attached to the light housing and a light housing attaching member for removably attaching the light housing to the top frontal area of a user's shoe, or on an other article of clothing. The movable plate has a swivel member attached to the movable plate, for vertical positioning of the light housing at an adjustable angle between 20 and 70 degrees relative to the ground. The leg is adjustably and fixedly attached to the top of the movable plate with a rotatable mechanical member and a frictional member, whereby allowing a three-hundred sixty degree rotation of the light housing for horizontal repositioning thereof and for orienting it to a selectively chosen fixed angular position, maintained by the frictional member.

SUMMARY OF THE INVENTION

An illuminated skateboard is disclosed including a light string, configured to produce light, mounted about a peripheral edge of a deck. The peripheral edge of the deck extends between a top surface and a bottom surface of the deck. The illuminated skateboard also includes a pair of trucks each having a pair of wheels for supporting the deck, and a driver circuit coupled between an electrical power source and the light string. The driver circuit provides electrical power from the electrical power source to the light string. A method for making the illuminated skateboard is also described.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
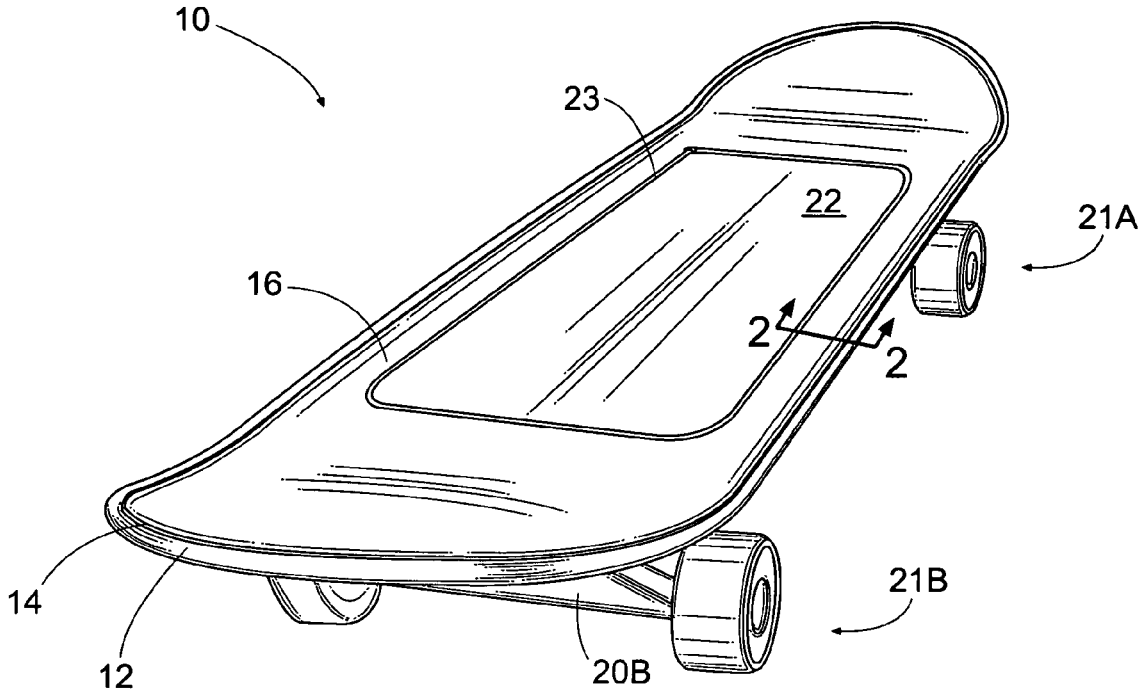
FIG. 1 is a perspective view of one embodiment of a skateboard including a light string mounted about a peripheral edge of a deck, wherein the light string is positioned in a hollow bumper attached to the peripheral edge of the deck.
Figure 2A:
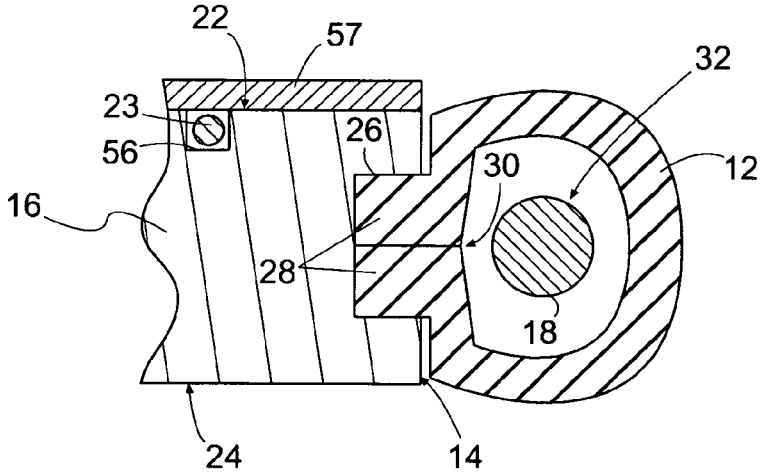
FIGS. 2A and 2B are cross-sectional views of different embodiments of the hollow bumper of FIG. 1 as taken along line 4—4 in FIG. 2.
Figure 2B:
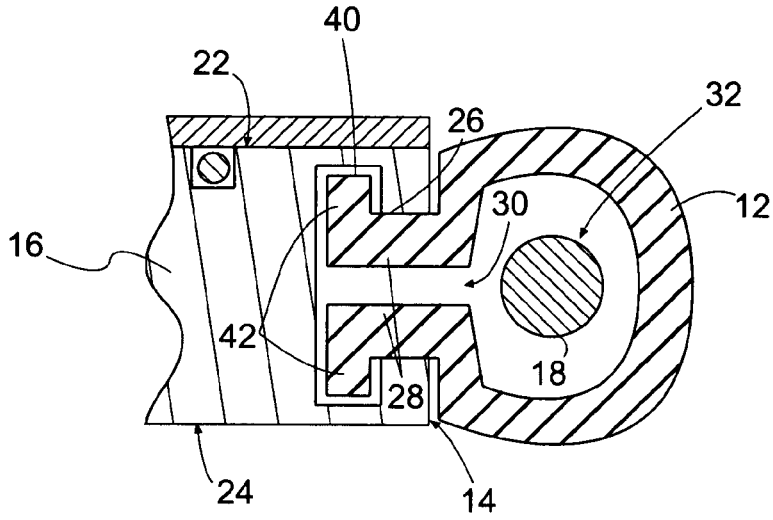

FIG. 1 is a perspective view of one embodiment of a skateboard 10 including a light string (shown in FIGS. 2A and 2B), configured to produce light, mounted about a peripheral edge 14 of a deck 16. In the embodiment of FIG. 1, the light string is positioned within a hollow bumper 12 attached to the peripheral edge 14 of the deck 16. FIGS. 2A and 2B are cross-sectional views of portions of different embodiments of the hollow bumper 12 of FIG. 1 as indicated in FIG. 1, and show the light string, labeled 18, positioned within the hollow bumper 12.

As shown in FIGS. 2A and 2B, the light string 18 is a visible light source that may include, for example, multiple light-emitting diodes (LEDs) connected one after another to form a string. The multiple LEDs may be the same or of different colors. Further, the LEDs may be turned on and off to flash in certain patterns, or sequentially such that it appears that the light emitted by the LEDs is moving around the peripheral edge 14 of the deck 16. Alternately, the light string 18 may be, for example, an electroluminescent (EL) strip. Although shown to have a substantially circular cross section in the embodiments of FIGS. 2A and 2B, the light string 18 may have any number of specific cross-sectional shapes, as dictated by the product selected by one skilled in the art.

The hollow bumper 12 substantially surrounds the light string 18, supports the light string 18, and protects the relatively fragile light string 18 from the elements and from impacts. The hollow bumper 12 is preferably formed from a waterproof, flexible, and relatively rugged material. In general, the hollow bumper 12 transmits at least a portion of the visible light generated by the light string 18. More preferably, the hollow bumper 12 substantially transmits the visible light generated by the light string 18. The hollow bumper 12 may be clear or colored. Examples of suitable materials include but are not limited to soft polyvinyl chloride (PVC), polyurethane, and any other material known to those skilled in the art that include suitable light transmission characteristics.

Referring back to FIG. 1, the peripheral edge 14 of the deck 16 extends between an upper surface 22 and a underside surface 24. The skateboard 10 includes a pair of trucks 20A and 20B attached to the underside surface 24 of the deck 16. The pair of trucks 20A and 20B could be standard skateboard trucks, or they could be more complex wheel attachment devices with suspensions (not shown), and any similar device should be considered within the scope of the term "truck." A pair of wheels 21A and 21B are rotatably attached to opposite ends of each of the trucks 20A and 20B, respectively. When the two pairs of wheels 21A and 21B are placed on a surface, the two pairs of wheels 21A and 21B support the deck 16 above the surface.

In the embodiment of FIG. 2A, the peripheral edge 14 has a groove 26, and the hollow bumper 12 has two radial projections 28 on either side of a slit 30 providing access to a hollow central portion 32 of the bumper 12. In one method for making the skateboard 10 of FIG. 1, the light string 18 is inserted into the hollow central portion 32 of the bumper 12 (e.g., via the slit 30). An adhesive material is inserted into the groove 26, and the radial projections 28 are inserted into the groove 26. The cured adhesive material attaches the bumper 12 to the peripheral edge 14 of the deck 16 and positions the light string 18, within the hollow bumper 12, adjacent the groove 26.

It is noted that in other embodiments, the hollow bumper 12 may have a single radial projection adjacent the slit 30. The skateboard 10 of FIG. 1 may be made by inserting the light string 18 into the hollow central portion 32 of the bumper 12 (e.g., via the slit 30). The adhesive material may be inserted into the groove 26, and the single radial projection may be inserted into the groove 26. As before, the cured adhesive material attaches the bumper 12 to the peripheral edge 14 of the deck 16 and positions the light string 18, within the hollow bumper 12, adjacent the groove 26. The slit 30 may be sufficiently closed and sealed by a resilient force within the bumper 12 and/or by the adhesive material.

In the embodiment of FIG. 2B, the peripheral edge 14 has the groove 26 of FIG. 2A and a slot 40 at an end of the groove 26 opposite the peripheral edge 14. The hollow bumper 12 has the two radial projections 28 of FIG. 2A, and the radial projections 28 have flanges 42 at ends. In another method of fabricating the skateboard 10 of FIG. 1, the light string 18 is inserted into the hollow central portion 32 of the bumper 12 via the slit 30. The radial projections 28 are inserted into the groove 26 such that the flanges 42 enter the slot 40 as shown in FIG. 2B. The anchored flanges 42 attach the bumper 12 to the peripheral edge 14 of the deck 16 and positions the light string 18, within the hollow bumper 12, adjacent the groove 26.

As shown in FIGS. 1, 2A, and 2B, the skateboard 10 may further include a top light string 23 mounted on the upper surface 22, for further decorating and illuminating the skateboard 10. The top light string 23 may be mounted in a top groove 56 and covered with a layer of grip tape 57 that transmits light; or, in alternative embodiments, the top light string 23 may be mounted on the upper surface 22 using another mounting method, or simply secured to the upper surface 22 using another fastening system.

Figure 3:
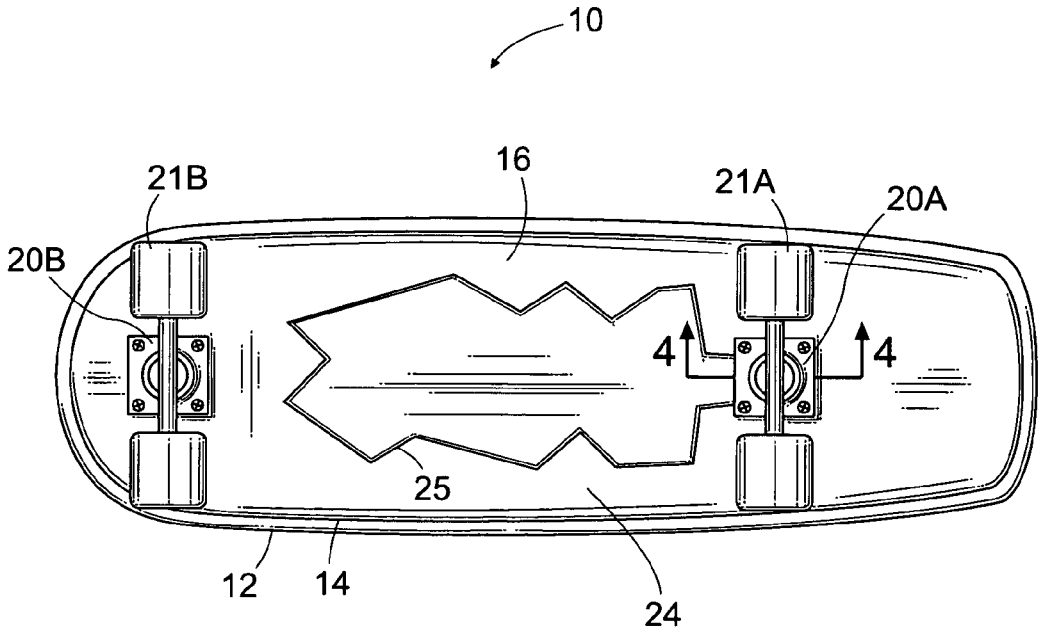
FIG. 3 is a bottom plan view of the skateboard 10 of FIG. 1.

FIG. 3 is a bottom plan view of the skateboard 10 of FIG. 1. As shown in FIG. 3, the skateboard 10 may further include a bottom light string 25 mounted on the underside surface 24, for further decorating and illuminating the skateboard 10. The bottom light string 25 may be mounted to the skateboard 10 using any of the above-described systems, or may simply be attached to the skateboard 10 with an ordinary fastener. The bottom light string 25 will most likely not be attached using grip tape, as described above, since grip is not important on the underside surface 24; however, other forms of light transmissive tape (transparent, translucent, etc.), hot glue, or other material could also be used.

Figure 4:
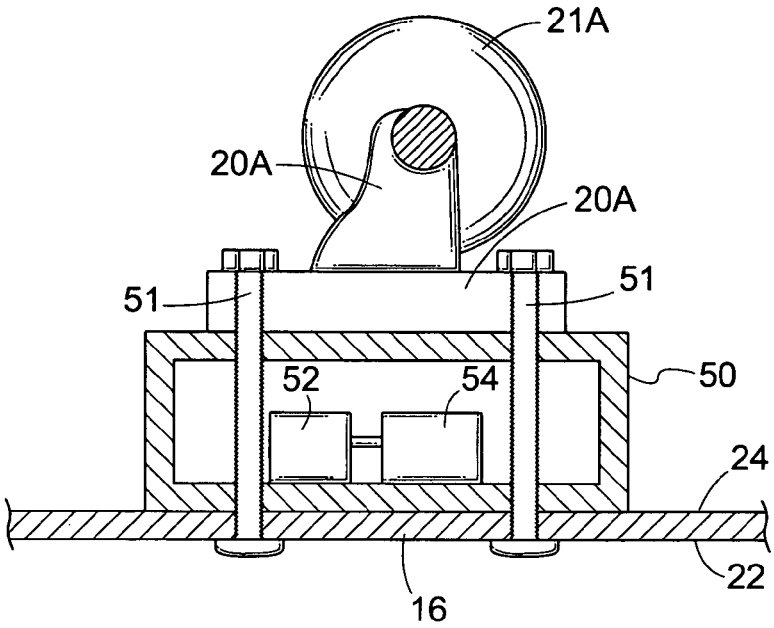
FIG. 4 is a cross-sectional view of the skateboard taken along line 4—4 in FIG. 2.

FIG. 4 is a cross-sectional view of a portion of the skateboard 10 of FIG. 3 about the truck 20A, as indicated in FIG. 3. In FIG. 4, a protective housing 50 is positioned between the truck 20A and an adjacent portion of the underside surface 24 of the deck 16. In the embodiment of FIG. 4, an electrical power source (i.e., power source) 52 and a driver circuit 54 are positioned within the protective housing 50. In general, the power source 52 produces electrical power and provides the electrical power to the driver circuit 54. The power source 52 may be or include, for example, a battery. In general, the driver circuit 54 provides electrical power to the light string 18 to ensure proper starting and a desired operation of the light string 18. The specific nature of the driver circuit 54 will vary depending upon the nature of the light string 18, and can be readily determined by those skilled in the art. The protective housing 50 shields the power source 52 and the driver circuit 54 from the elements and other forms of damage. Since the skateboard 10 is typically exposed to rugged use, the protective housing 50 must be strong enough to protect the power source 52 and the driver circuit 54 from substantial physical impacts.

In other embodiments, some or all of the power source 52 may be positioned outside the protective housing 50. For example, the power source 52 may be or include a generator coupled to a wheel of the truck 20A or the truck 20B. The generator expectedly produces electrical power when the corresponding wheel is turning.

The truck 20A is attached to the underside surface 24 of the deck 16 via four nuts and bolts 51, two of which are shown in FIG. 4. In the embodiment of FIG. 4, the four bolts 51 pass through the protective housing 50.

Figure 5:
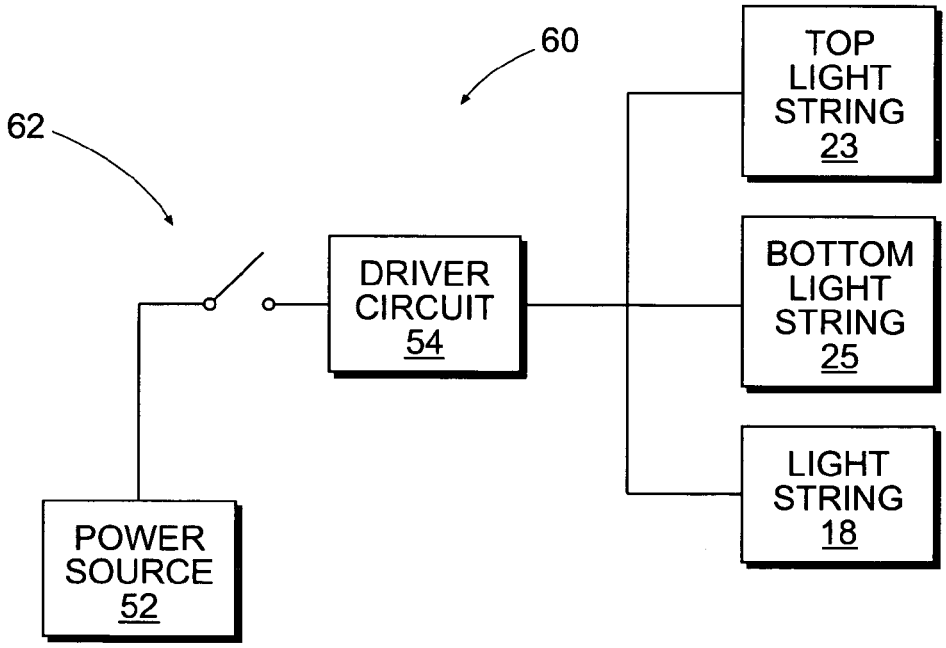
FIG. 5 is a diagram of a electric circuit formed in the skateboard of FIG. 1.

FIG. 5 is a diagram of a electric circuit 60 formed in the skateboard 10 of FIG. 1. In the circuit 60 the power source 52 is connected to an input of the driver circuit 54 via a switch 62. In the embodiment of FIG. 5, the switch 62 is operated by a user of the skateboard 10. An output of the driver circuit 54 is connected to the light string 18. The light string 18 is activated and produces light when the switch 62 is closed by the user, and is deactived and does not produce light when the switch 62 is opened by the user.

As described above, the driver circuit 54 generally produces electrical voltage and current required by the light string 18 for proper starting and desired operation. For example, the light string 18 may include multiple LEDs coupled in series and/or in parallel. In this situation, the driver circuit 54 may simply limit the electrical current and/or voltage provided to the LEDs such that the LEDs do not draw excessive electrical power and fail prematurely. Alternately, the driver circuit 54 may provide electrical power to the LEDs such that the LEDs are turned on and off to flash in certain patterns, or sequentially such that it appears that the light emitted by the LEDs is moving around the peripheral edge 14 of the skateboard 10 of FIG. 1.

Alternately, the light string 18 may be an EL strip as described above. In general, EL devices require an alternating current (AC) voltages having suitable magnitudes and frequencies to stimulate phosphor coatings sandwiched between pairs of electrodes. In this situation, the driver circuit 54 may be an inverter circuit that generates an AC voltage having a suitable magnitude and frequency, and provides the AC voltage to the EL strip.

It is noted that in other embodiments, the switch 62 may not be operated by the user. For example, the switch 62 may be, or be part of, a motion sensing mechanism or circuit wherein the switch 62 is automatically activated when the skateboard 10 is moved (e.g., during use).

Further, the switch 62 may be eliminated in some embodiments, and the power source 52 may be connected directly to the input of the driver circuit 54. For example, as described above, the power source 52 may be or include a generator coupled to a wheel of the truck 20A or the truck 20B. In this situation the generator expectedly produces electrical power only when the corresponding wheel is turning (i.e., when the skateboard 10 is in use). When the power source 52 is a generator and is connected directly to the input of the driver circuit 54, the light string 18 is expectedly activated and produces light only when the corresponding wheel is turning (i.e., when the skateboard 10 is in use).

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An illuminated skateboard, comprising:

a deck having a peripheral edge extending between a top surface and a bottom surface, the peripheral edge having a groove;

a bumper having a hollow central portion, a slit adapted for providing access to the hollow central portion, and a radial projection on either side of the slit, the radial projections being adapted to fit into the groove such that the bumper is supported by the deck and held in place by the groove, while the hollow central portion remains outside of the groove;

a light string mounted outside of the groove and within the hollow central portion of the bumper such that the bumper surrounds the light string and supports and protects the light string, wherein the bumper transmits at least a portion of the light produced by the light string;

a pair of trucks each having a pair of wheels for supporting the deck;

an electrical power source; and a driver circuit coupled between the electrical power source and the light string and configured to provide electrical power from the electrical power source to the light string.

2. The illuminated skateboard of claim 1, wherein the light string comprises an electroluminescent strip or a plurality of light-emitting diodes.

3. The illuminated skateboard of claim 1, further comprising a protective housing mounted between one of the trucks and the bottom surface of the deck, wherein the driver circuit is positioned within the protective housing.

4. The illuminated skateboard of claim 3, wherein the electrical power source and the driver circuit are positioned within the protective housing.

* * * * *